United States Patent [19]

Kim

[11] Patent Number: 4,932,851

[45] Date of Patent: Jun. 12, 1990

[54] NOISE REDUCTION OF ROTARY COMPRESSOR BY PROPER LOCATION OF DISCHARGE PORT

[75] Inventor: Jeung T. Kim, Schenectady, N.Y.

[73] Assignee: General Electric Company, Schenectady, N.Y.

[21] Appl. No.: 288,345

[22] Filed: Dec. 22, 1988

[51] Int. Cl.[5] ..... F04C 18/356; F04C 29/06

[52] U.S. Cl. ..... 418/63; 418/181

[58] Field of Search ..... 418/63-67, 418/181; 417/312

[56] References Cited

U.S. PATENT DOCUMENTS

| | | | |
|---|---|---|---|
| 2,020,987 | 11/1935 | Ayres | 418/63 |
| 2,246,272 | 6/1941 | Davidson | 418/64 |
| 4,483,305 | 11/1984 | Gilmor | 418/63 |

*Primary Examiner*—John J. Vrablik

*Attorney, Agent, or Firm*—John S. Beulick; James C. Davis, Jr.; Paul R. Webb, II

[57] ABSTRACT

Noise reduction is provided in a rotary compressor by selecting the location of the opening of the discharge port so as to minimize the transmission of noise by the discharge compressed gasses. In particular, the discharge port opening is located in the middle (i.e., in an axial direction) of the cylinder wall of the rotary compressor corresponding to a node in a first thickness mode standing wave. This corresponds to ¼ wavelength relative to the thickness mode standing wave from the end plate. Additionally, the opening is located ¼ wavelength from the corner or edge at which the sliding vane is positioned, this ensuring that the opening is at a node in a first cylindrical mode standing wave set up in the compression chamber. The discharge port includes a passage extending through the cylindrical wall and a passage extending through the end plate.

18 Claims, 2 Drawing Sheets

NOISE REDUCTION OF ROTARY COMPRESSOR BY PROPER LOCATION OF DISCHARGE PORT

BACKGROUND OF THE INVENTION

This invention relates to a reduced noise rotary compressor. More specifically, this invention relates to reducing the noise of a rotary compressor by choosing a proper location for the discharge port.

A rotary type of compressor commonly used in connection with refrigerators has a strong high frequency noise component of around 4 KHz. The primary noise source in the compressors is the pressurized refrigerant gas inside the compressor chamber. The noise level is especially high when the compressed gas discharges through the port. During the compression cycle, the refrigerant gas pressure reaches up to 200 psi and maximum sound pressure level (SPL) in the compressor chamber is about 120 dB.

Various methods of reducing the rotary compressor noise have previously been considered.

One approach is to attempt to redesign the casing of the rotary compressor so as to reduce the sound radiation from it. The noise heard by the human ear results from the casing vibration, which encloses the whole compressor structure. Modifying the sound radiation pattern is necessary under this approach. The radiation pattern can be modified by changing the bending rigidity of the compressor, i.e., changing the casing thickness or adding stiffness to the casing. However, redesigning the casing requires a substantial cost and is therefore undesirable.

Another way of attenuating the compressor noise is by controlling the compressor gas spectrum directly. Any resonator type of device built into the discharge port works as a mechanical filter. This may adversely affect the compressor efficiency depending on the structure of the resonator.

The human ears are most sensitive to noise in a frequency band including 4 KHz. As discussed above, the sound generated by a particular rotary type of compressor as commonly used for consumer refrigerators falls within this general region.

Although the above mentioned approaches have been somewhat useful, there remains a need for significantly reducing the noise from a rotary compressor without adversely affecting the efficiency of the compressor.

OBJECTS AND SUMMARY OF THE INVENTION

Accordingly, it is a primary object of the present invention to provide a new and improved compressor design.

A more specific object of the present invention is to provide a compressor design having a noise reduction arrangement which is relatively easy and inexpensive to implement.

A further object of the present invention is to provide a noise reduction technique for a rotary compressor which does not require additional parts beyond those previously used.

Yet another object of the present invention is to provide a noise reduction arrangement for a rotary compressor which has little or no effect on the compressor efficiency.

The above and other objects of the present invention which will become more apparent as the description proceeds are realized by a rotary compressor including a cylindrical wall and a compression chamber within the cylindrical wall. A roller is mounted for eccentric rotation along an axis within the cylindrical wall. Two end plates close off two ends of the compression chamber. A vane is slidably mounted in a slot in the housing. A discharge port has an opening in the compression chamber. The slot has a close side relatively close to the opening and a far side relatively far from the opening.

Significantly, the opening is spaced from the close side by distance dc which is within 20% of $\frac{1}{4}$ wavelength of a first cylindrical mode standing wave of noise within the compression chamber. The distance dc is greater than 2 millimeters and is specifically within 10% of $\frac{1}{4}$ wavelength of the first cylindrical mode standing wave. Even more specifically, the distance dc should be within 5% of $\frac{1}{4}$ wavelength of the first cylindrical mode standing wave. Effectively, the opening is disposed at a node of the first cylindrical mode standing wave so as to minimize noise. The first cylindrical standing wave has a frequency greater than 2 KHz. The discharge port includes a first passage extending through the cylindrical wall and a second passage extending through one of the end plates.

Significantly, the opening is located in the cylindrical wall at a distance dp from one of the end plates (distance dp being transverse in direction to distance dc) and the distance dp is within 20% of $\frac{1}{4}$ wavelength of a first thickness mode standing wave of noise in the compression chamber. The thickness mode corresponds to waves in a direction parallel to the axis. Specifically, the distance dp is within 10% of $\frac{1}{4}$ wavelength of the first thickness mode standing wave and, more specifically, is within 5% of $\frac{1}{4}$ wavelength of the first thickness mode standing wave. Accordingly, the opening is at a node of the first thickness mode standing wave. The first thickness mode standing wave has a frequency greater than 2 KHz and less than 6 KHz. The distance dp is greater than 2 mm. The opening is located more specifically midway between the two end plates. The distance dc is within 10% of the distance dp.

BRIEF DESCRIPTION OF THE DRAWINGS

The above and other features of the invention will be more readily understood when the following detailed description is considered in conjunction with the accompanying drawings wherein like characters represent like parts throughout the several views and in which.

DETAILED DESCRIPTION

Figure 1:
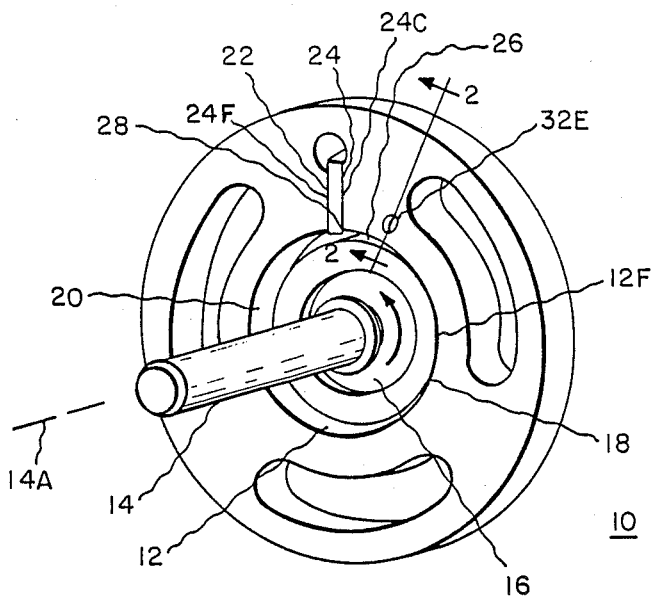
FIG. 1 shows a perspective view of a rotary compressor according to the present invention.

As shown in FIG. 1, a rotary compressor 10 includes a cylindrical wall 12. A shaft 14 having an eccentric 16 is within the cylindrical wall 12. A roller or rolling piston 18 is disposed to rotate eccentrically within the cylinder wall 12 upon rotation of the shaft 14 and eccentric 16. The shaft 14, eccentric 16, and roller 18 rotate about an axis 14A which is displaced from the central axis (not shown) of the cylindrical wall 12.

Within the cylindrical wall 12 is a suction chamber 20 which receives refrigerant gas through an inlet port (not shown) in known fashion. A sliding vane 22 is disposed in a generally radial slot 24 within the cylindrical wall 12. A compression chamber 26 provides for the compression of refrigerant gasses by the eccentric rotation of the roller or rolling piston 18 in known fashion. For ease of illustration, an outer casing, end plates, motor (which rotates shaft 14) and other parts common to a rotary compressor such as 10 are not shown.

In order to reduce the noise of the compressor 10, the present invention uses a discharge port (not visible in FIG. 1) especially positioned relative to the compression chamber 26 as will be discussed below with reference to FIGS. 2 and 3. It should be noted initially that a previous compressor design has used a discharge port located at the corner 28 where the cylindrical wall 12 intersects with a close side 24C of the slot 24. (Slot 24 also has a far side 24F, i.e., relatively far from the compression chamber 26 and the associated discharge port.) It should be appreciated that each of the sides 24F and 24C of slot 24 extend in depth parallel to the axis 14A. However, the prior arrangement for positioning the discharge port generally used a quarter hemisphere depression or machined out portion (not shown) at the intersection between the front edge of side 24C and the front edge 12F of cylindrical wall 12. An end plate (not shown in FIG. 1) in the previous design included a passage serving as the conduit part of the discharge port.

Figure 2:
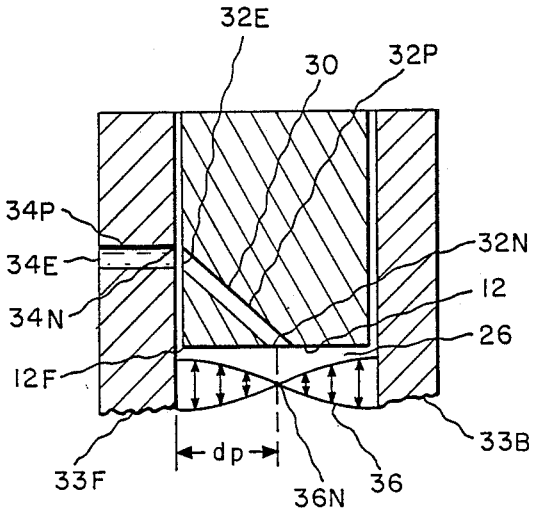
FIG. 2 shows a cross-section view along lines 2—2 of FIG. 1 of portions of the present invention and schematically illustrating a first thickness mode standing wave.

With reference now to FIG. 2, a drain port 30 includes an opening 32N disposed in the middle (i.e., in the axial direction corresponding to axis 14A of FIG. 1 and which direction is from left to right in FIG. 2) of the compression chamber 26. Note that the compression chamber 26 is bounded by a front end plate 33F and a back end plate 33B. Only portions of the end plates are shown as they are conventional structures except that end plate 33F has a portion of the discharge port 32 disposed therein in a unique location. As shown, the discharge port 30 includes a passage 32P extending in a straight line between the opening 32N and an exit opening 32E. The passage 32P communicates with passage 34P extending through end plate 33F and including an opening 34N which is in registry with exit 32E. If desired, a sealing arrangement could be included around the interface between exit 32E and opening 34N. The passage 34P extends to an exit 34E. A discharge valve (not shown) might be located over exit 34E and functions in known fashion.

The importance of positioning the opening 32N midway between the front end plate 33F and back end plate 33B may best be explained by reference to the illustrated first thickness standing wave 36 of noise. The thickness mode corresponds to standing waves of noise extending parallel to axis 14A of FIG. 1 (left to right in FIG. 2). This direction corresponds to the width of the cylindrical wall 12 or the thickness of the compression chamber.

For a particular embodiment of the present invention, the distance between the front end plate 33F and the back end plate 33B is about 1.6 cm such that the illustrated first thickness mode 36 would be a high frequency. If the speed of sound inside the chamber is 140 meters/second (a reasonable figure for a typical refrigerant gas such as R-12), 4.3 KHz is the first mode. As shown, the nodal point 36N is located a distance dp from the front end plate 33F. For the given cylinder thickness, this distance would be ¼ wavelength corresponding to 8 mm. The cylinder thickness is not changed by rotation of the roller 18 (refer back momentarily to FIG. 1) such that the first thickness mode standing wave 36 has a fixed frequency independent of the angle of the roller 18. By locating the opening 32N at the node 36N, the pressurized gas which is discharged will have essentially no component corresponding to the standing wave frequency.

Figure 3:
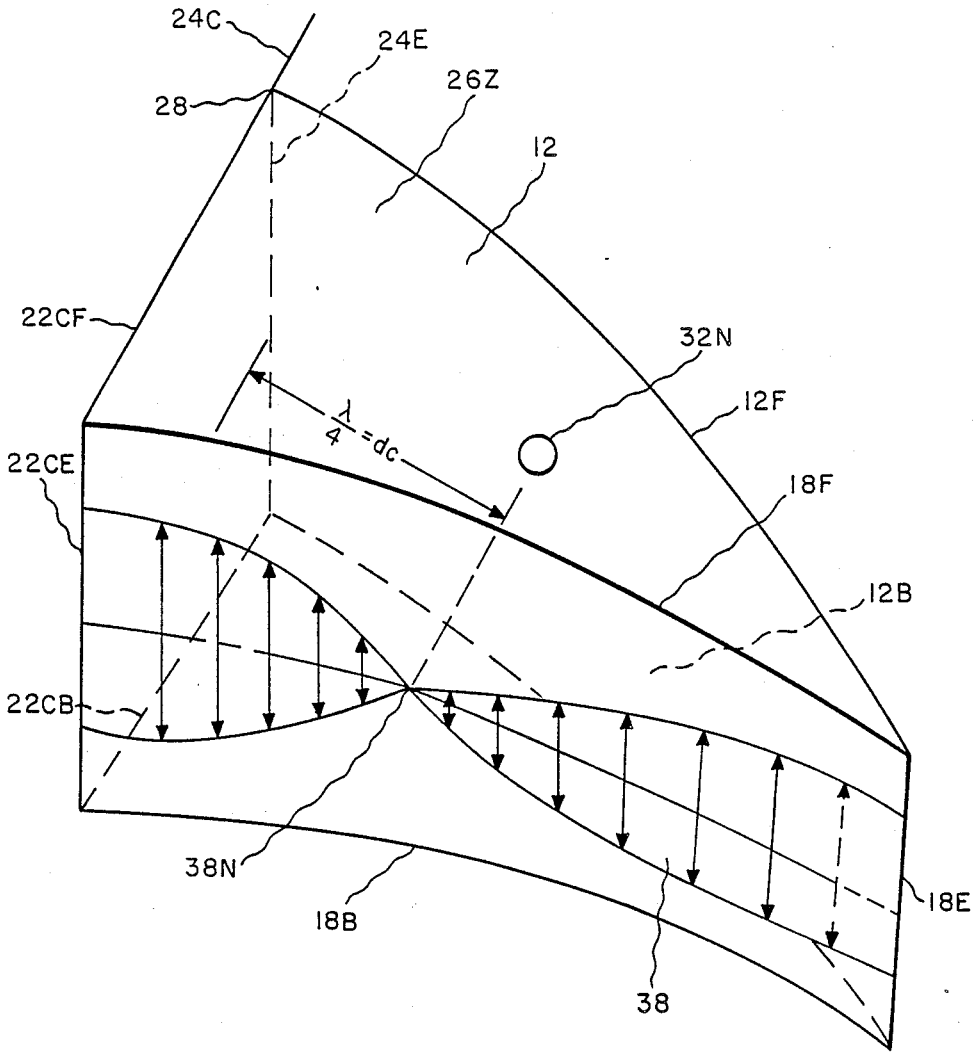
FIG. 3 shows a perspective view of a volume representative of the compression chamber together with a graphic illustration of a cylindrical mode standing wave.

With reference now to FIG. 3, the location of the opening 32N about the circumference of the cylinder 12 will be discussed. FIG. 3 shows a perspective view of a generally wedge shaped zone designated 26Z corresponding to compression chamber 26 when the roller 18 (not separately shown in FIG. 3) is in a particular position during compression of the gas within zone 26. The gas would be bounded within the illustrated zone by an inside surface defined by cylindrical line 18F corresponding to a front edge of the roller 18, cylindrical lines 18B corresponding to a back edge of the roller 18, line 22CE corresponding to the compression side of sliding vane 22 (22 is in FIG. 1 only), and line 18E corresponding to the place where the roller 18 meets the cylindrical wall 12 for the illustrated angular position of roller 18.

The zone 26Z has an outer boundary corresponding to wall 12 and defined by the lines 12F which is the front edge of cylindrical wall 12, 12B which is the back edge of wall 12, the previously mentioned line 18E, and a line 24E corresponding to the intersection of the side 24C of the slot 24 (slot 24 shown in FIG. 1 only) with the cylindrical wall 12.

A side boundary to the zone 26Z is defined by a surface having previously mentioned lines 24E and 22CE and lines 22CF and 22CB corresponding respectively to front and back edges of the sliding vane 22 side nearest the compression chamber 26. Basically, the surface bounded by lines 22CF, 22CE, 22CB, and 24E corresponds to a surface of the sliding vane 22 when the vane has closed off the compression chamber 26.

It should be noted that the lines 18E, 22CE, and 24E are parallel to the axis 14A (axis 14A in FIG. 1 only).

A first cylindrical mode standing wave 38 of noise is illustrated graphically in FIG. 3. This standing wave 38 extends between the surface corresponding to lines 22CF, 22CE, 22CB, and 24E and the edge 18E. As the edge 18E moves closer to line 24E when the roller 18 advances in its angular position (i.e., advances from the position corresponding to the illustrated cavity geometry), the size of the cavity holding the compressed gas becomes smaller. As the size of this cavity becomes smaller, the wavelength of the first cylindrical mode frequency overlaps the constant thickness mode frequency discussed above, the trouble noise frequency becomes higher. Accordingly, the present invention locates the opening 32N in such a way as to avoid the cylindrical mode frequency. As shown in FIG. 3, the opening 32N is spaced a distance dc from the edge 24E. This distance is equal to ¼ of the wavelength of the thickness mode frequency which, for the position corresponding to FIG. 3, is equal to the above discussed first thickness mode frequency.

Considering FIG. 2 and FIG. 3 together, it will be apparent that the opening 32N is positioned at the location of a node for the first thickness mode standing wave and a mode for the first cylindrical mode standing wave. In a particular embodiment of the present invention wherein the cylinder thickness is about 1.6 cm, both of the distances dp and dc would be equal to about 8 mm. It should be noted that if one was not concerned about the cylindrical mode standing wave for a particular rotary compressor, one could mount the opening 32N at the midway point along edge 24E. Likewise, if a particular rotary compressor design had a thickness mode standing wave which was of little concern (as for example having a frequency outside the bands at which the human ear is most sensitive), one could mount the opening 32N right along the arcuate line 12F at a distance dc from edge 24E. In such a case, the distance dc would of course correspond to a ¼ wavelength of the particular frequency of cylindrical mode standing wave which is most objectionable or which one wants to attenuate.

The distances dp and dc would advantageously be within 20% of a ¼ wavelength of the respective cylindrical mode standing wave and thickness mode standing wave, but these distances would more specifically be within 10% of the designated amounts. Most specifically, the distances would be within 5% of the specified values. The positioning might also be specified by stating that dp and dc should each be within 20% of one-half the cylinder thickness (distance from front end plate 33F to back end plate 33B) and more specifically with 10% of one-half of the cylinder thickness. Most specifically, the values for dp and dc should be within 5% of one-half thickness. It should again be noted that this assumes that the opening is circumferentially located (i.e., distance dc is determined) to minimize a cylindrical mode standing wave with the same frequency as the thickness mode standing wave. If the opening was to be circumferentially located to avoid a different frequency, the distance dc might vary significantly from half of the thickness (i.e., one quarter of the thickness mode wavelength). In any event, the frequencies of the first thickness mode standing wave and the first cylindrical mode standing wave should be between 2 KHz and 6 KHz and, more specifically, within 1 KHz bandwidth centered at 4 KHz. The positioning of opening 32N as discussed above should be considered as referenced to its center. Each of the distances dc and dp are greater than 2 mm and more specifically greater than 4 mm. It should also be noted that both distances dc and dp would most specifically be greater than 6 mm. In the preferred embodiment, the distance dc should be within 10% of the distance dp.

It should also be noted that the previous placement of the discharge port at the corner 28 (recalling that the discharge port had a ¼ hemisphere cut out or machined out portion adjacent to a passage through the end wall) actually had the discharge port at the worst possible location caused the discharged pressurized gas to have maximum components corresponding to the standing waves.

With reference again to FIG. 2, the construction of the present invention will briefly be discussed. In particular, the passage 32P may simply be drilled in a straight line through the cylindrical wall 12. The passage 32P may in end view (a planar view normal to axis 14A) appear radial to axis 14A (FIG. 1 only) or radial to the central axis of symmetry (not shown) of the cylindrical wall 12. The passage 32P is skewed as shown in FIG. 2 so that exit 32E is on a side wall above 12F and is not on the outer periphery of the wall. As used herein, passage shall refer to a duct which is enclosed around 360°. The passage 34P may simply be a straight line hole parallel to axis 14A and drilled through the end plate 32F. It is desirable for the discharge port 30 including passages 32P and 34P to have a small volume and the arrangement of FIG. 2 generally meets that goal while allowing easy construction of the drain port 30. The assembly of the compressor 10 may advantageously be accomplished using previously known steps.

Although various specific constructions and details have been discussed herein, it is to be understood that these are for illustrative purposes only. Various modifications and adaptations will be apparent to those of skill in the art. Accordingly, the scope of the present invention should be determined by reference to the claims appended hereto.

What is claimed is:

1. A rotary compressor comprising:

a cylindrical wall;

a compression chamber within said cylindrical wall;

a roller mounted for eccentric rotation about an axis within said cylindrical wall;

two end plates closing off two ends of said compression chamber;

a vane slidably mounted in a slot in said cylindrical wall;

a discharge port having an opening in said compression chamber; and wherein said slot has a close side relatively close to said opening and a far side relatively far from said opening, and wherein said opening is spaced from said close side by a distance dc which is within 20% of 174 wavelength of a first cylindrical mode standing wave of noise within said compression chamber, said first cylindrical mode standing wave of noise corresponding to a direction perpendicular to said axis.

2. The rotary compression of claim 1 wherein said distance dc is greater than 2 mm.

3. The rotary compression of claim 2 wherein distance dc is within 10% of ¼ wavelength of the first cylindrical mode standing wave of noise within said compression chamber.

4. The rotary compression of claim 3 wherein distance dc is within 5% of ¼ wavelength of the first cylindrical mode standing wave of noise within said compression chamber.

5. The rotary compression of claim 3 wherein said first cylindrical mode standing wave of noise has a frequency greater than 2 KHz.

6. The rotary compression of claim 5 wherein said discharge port includes a first passage extending through said cylindrical wall and a second passage extending through one of said end plates.

7. The rotary compression of claim 6 wherein said opening is located in said cylindrical wall at a distance dp from one of said end plates and distance dp is within 20% of ¼ wavelength of a first thickness mode standing wave of noise in said compression chamber, said first thickness mode corresponding to a direction parallel to said axis.

8. The rotary compression of claim 7 wherein distance dp is within 10% of ¼ wavelength of said first thickness mode standing wave of noise.

9. The rotary compression of claim 3 wherein said discharge port includes a first passage extending through said cylindrical wall and a second passage extending through one of said end plates.

10. The rotary compression of claim 9 wherein distance dp is within 10% of ¼ wavelength of said first thickness mode standing wave of noise, and wherein said first cylindrical mode standing wave of noise has a frequency greater than 2 KHz, and wherein said first thickness mode standing wave of noise has a frequency greater than 2 KHz.

11. The rotary compression of claim 10 wherein said opening is located midway between said two end plates.

12. A rotary compressor comprising:

a cylindrical wall;

a compression chamber within said cylindrical wall;

a roller mounted for eccentric rotation about an axis within said cylindrical wall;

two end plates closing off two ends of said compression chamber;

a vane slidably mounted in a slot in said cylindrical wall;

a discharge port having an opening in said compression chamber, and wherein said opening is located in said cylindrical wall at a distance dp from one of said end plates and distance dp is within 20% of ¼ wavelength of a first thickness mode standing wave of noise in said compression chamber, said first thickness mode corresponding to a direction parallel to said axis, said slot having a close side relatively close to said opening and a far side relatively far from said opening, and wherein said opening is spaced from said close side by a distance dc which is within 20% of ¼ wavelength of a first cylindrical mode standing wave of noise within said compression chamber, said first cylindrical mode standing wave of noise corresponding to a direction perpendicular to said axis.

13. The rotary compression of claim 12 wherein said distance dp is within 10% of ¼ wavelength of said first thickness mode standing wave of noise.

14. The rotary compression of claim 13 wherein said discharge port includes a first passage extending through said cylindrical wall and a second passage extending one of said end plates.

15. The rotary compression of claim 14 wherein said first thickness mode standing wave of noise has a frequency greater than 2 KHz.

16. The rotary compression of claim 12 wherein said distance dp is within 10% of one-half of the distance between said two end plates.

17. The rotary compression of claim 12 wherein said distance dc is greater than 2 mm and said distance dp is greater than 2 mm.

18. The rotary compression of claim 12 wherein said distance dc is within 10% of the distance dp.

* * * * *